United States Patent [19]

Masters

[11] 4,229,002

[45] Oct. 21, 1980

[54] GOLF SWING EXERCISE DEVICE

[76] Inventor: David H. Masters, 7254 Blanco, #101, San Antonio, Tex. 78216

[21] Appl. No.: 944,417

[22] Filed: Sep. 21, 1978

[51] Int. Cl.[3] ..... A63B 21/06

[52] U.S. Cl. ..... 272/117; 273/191 B; 272/143; 272/900; 272/67

[58] Field of Search ..... 272/118, 117, 116, 124, 272/142, 900, DIG. 4, 140, 135; 273/191 B, 193 A; 128/25 R, 84 C

[56] References Cited

U.S. PATENT DOCUMENTS

| | | | |
|---|---|---|---|
| 1,137,349 | 4/1915 | Patterson | 272/140 |
| 1,213,373 | 1/1917 | Hollowell | 128/84 C |
| 2,847,234 | 8/1958 | Brandon . | |
| 2,938,695 | 5/1960 | Ciampa | 272/900 X |
| 3,462,159 | 8/1969 | Gentry | 273/191 B X |
| 3,640,528 | 2/1972 | Proctor | 272/118 |
| 3,737,661 | 6/1973 | Moller . | |
| 3,814,084 | 6/1974 | Gustafson | 272/900 X |
| 3,966,203 | 6/1976 | Bickford | 273/191 B X |

*Primary Examiner*—Richard C. Pinkham
*Assistant Examiner*—William R. Browne
*Attorney, Agent, or Firm*—Gunn & Lee

[57] ABSTRACT

A golf swing exercise device for utilization indoors. The device is designed to be suspended on a door by means of a horizontal base to which is secured door hooks. An elongated "T" beam extending outward normal to the base supporting pulleys. The "T" beam is stabilized by beam stabilizers diagonally projecting from each side of the "T" beam to a vertical beam. A rope extending through the pulleys secured to the "T" beam. A golf grip and stub shaft is securely attached to one end of the rope and the weight attached to the opposite end of the rope. A grasping of the golf grip by an operator simulating a golf swing reciprocates the weight attached to the rope.

6 Claims, 6 Drawing Figures

GOLF SWING EXERCISE DEVICE

BACKGROUND OF THE INVENTION

1. Field of the Invention

This invention pertains to a golf swing exercise device for utilization indoors or outdoors. The invention can be utilized to strengthen the muscles used in a golf swing as well as reinforcing neuromuscular reflexes necessary to produce proper weight shift and wrist action. The equipment of this invention may be attached to a door or wall and utilized by a golfer as a training or exercise device on any desired occasion.

2. DESCRIPTION OF THE PRIOR ART

In a sport with the popularity and interest generated such as golf, numerous prior developments have been patented. Among these are devices such as Brandon, U.S. Pat. No. 2,847,234, which employs an elastic member or spring to attach to a golf grip to resist the swing of the golfer. Gentry, U.S. Pat. No. 3,462,159, employs a spring loaded reel-like device attached to a stationary object which extends a flexible cord secured to the golf grip like extension. Moller, U.S. Pat. No. 3,737,661, employs an elongated structure with braking means at its base to resist the simulated golf swing affording exercise and training to the user. Bickford, U.S. Pat. No. 3,966,203,utilizes a suspended weight attached to a cord leading through fairleads which are attached to the head of a golf club to load the golf club during practice or exercise swings.

The vast majority of prior art structures resist the swing of the golfer at an angle to the body. The device of this invention at the initiation of the down swing at the exact point of ceasing the back swing, loads the club or the simulated club exactly overhead. The device of this invention in this overhead point of resistance differs from existing prior art devices.

SUMMARY OF THE INVENTION

The device of this invention is portable and may be attached to a door or any type of overhead beam for use in exercise or training. A horizontal base projects along the upper extremity of a door and is retained in position by door hook means. An alternative installation would be to secure the base to a wall. Projecting outward from the horizontal base is an elongated projecting beam securely attached to the base. Attached to this projecting beam is a first pulley adjacent to the base means and a second pulley near the outer extremity of the projecting beam. A rope or flexible cord operably passes through the two pulleys with a weight secured to the flexible cord adjacent the base end and a golf grip with shaft is secured to the opposite end of the flexible cord. In utilizing the device, the golfer grasps the golf grip at the overhead position simulating the end of the back swing. In exercising with the device, the simulated down swing, weight shift, body movement, wrist action, and follow through are practiced. The device strengthens and exercises those muscles utilized in the golf swing as well as reinforcing the neuromuscular reflexes which are essential to the training and conditioning of the golfer. The accomplishment of utilization of this device assists in the proper transition from the back swing to down swing, the shift of the body weight and wrist action at the point of simulated ball contact. The primary difference and improvement believed to be incorporated in the device of this invention is the arrangement of the structure which is elevated above the golfer and affords a resistive force at the point of the initiation of the down swing. The components and the arrangement of the components of this invention, their position, and configuration enhance the improved result of training with this device.

BRIEF DESCRIPTION OF THE DRAWINGS

For a description of the construction and utilization of the preferred embodiment, reference is made to the attached several views wherein identical reference characters will be employed to refer to identical or equivalent components throughout the several views and the following detailed description.

DESCRIPTION OF THE PREFERRED EMBODIMENT

Figure 1:
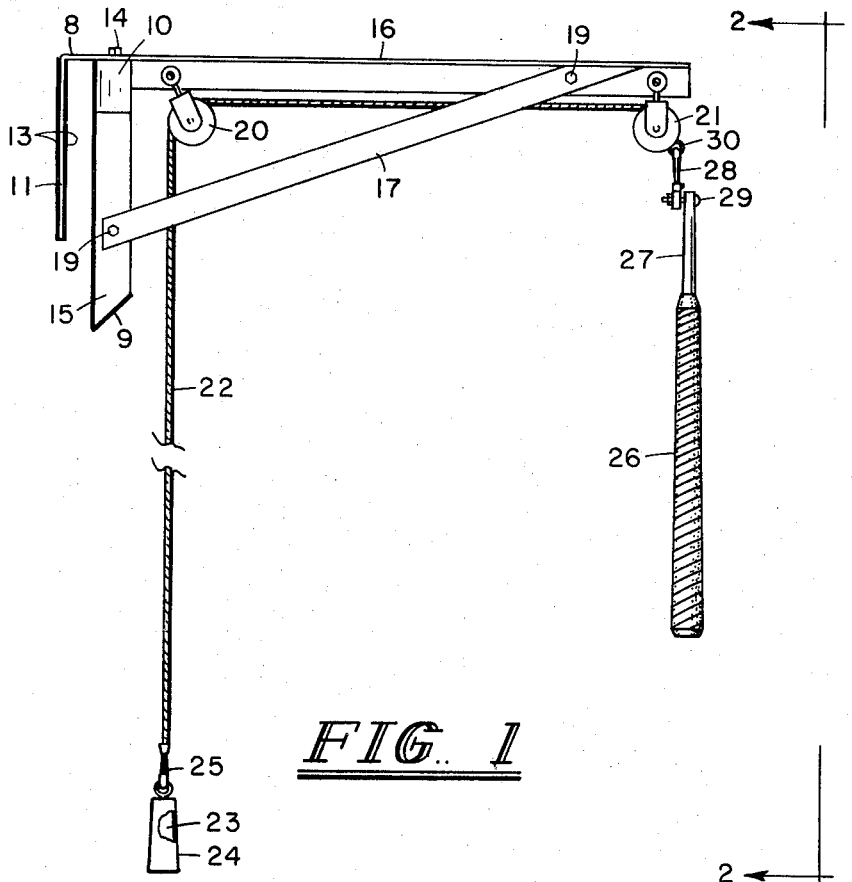
FIG. 1 is a side elevation view of the device in a simulated position suspended from the top of a door or supporting beam.
Figure 2:
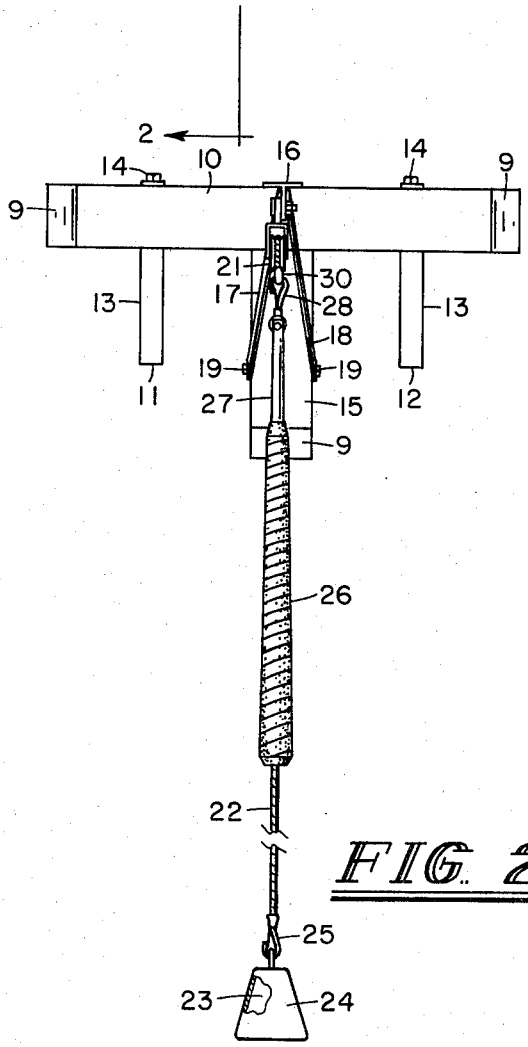
FIG. 2 is a front elevation view of the device also suspended from a door or a beam from a position of substantially on line 2—2 of FIG. 1 looking in the direction of the arrows.
Figure 3:
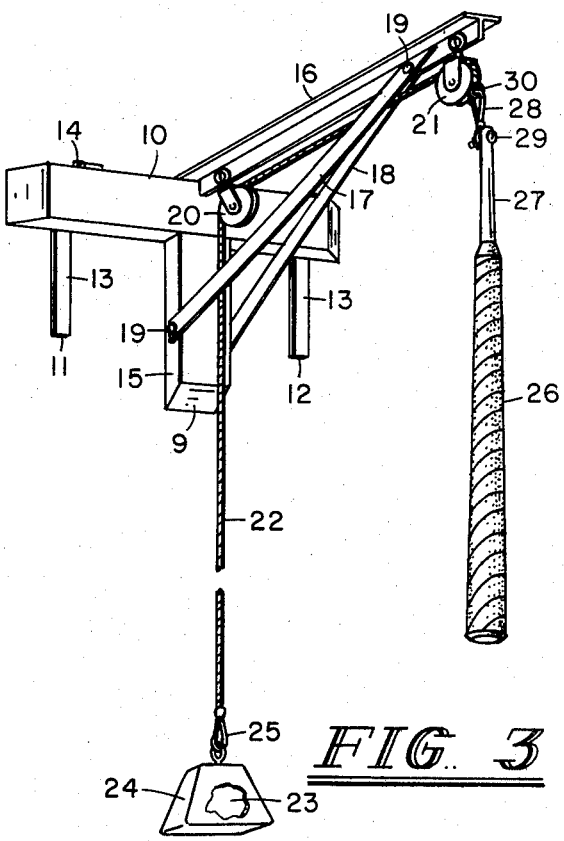
FIG. 3 is a side, perspective view of the device from a position slightly below the device.
Figure 4:
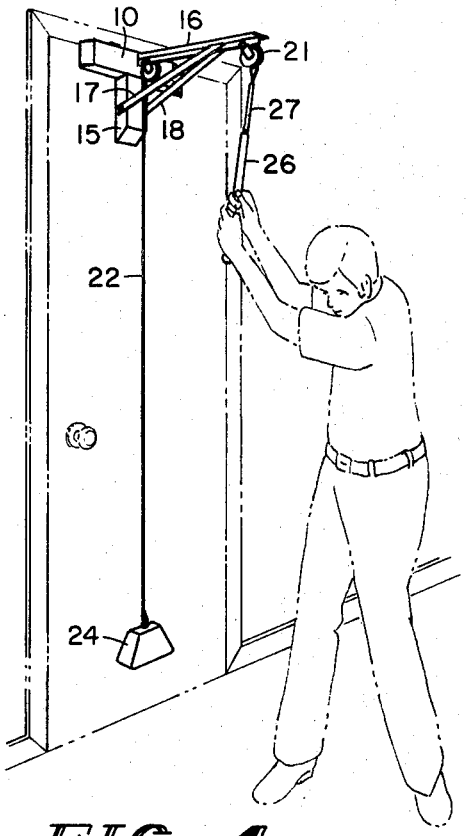
FIG. 4 is a simulated view of a golfer utilizing the device at the peak of the back swing.
Figure 5:
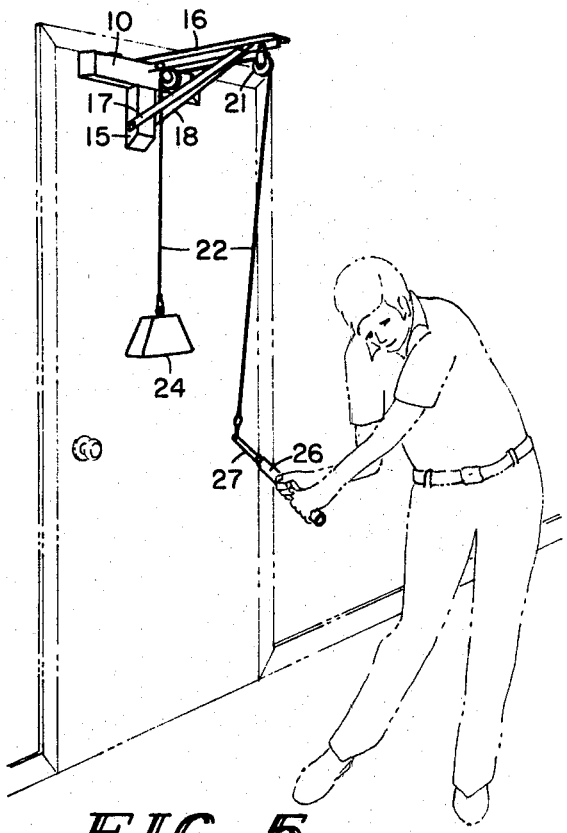
FIG. 5 is a simulated view of a golfer utilizing the device at the mid point of the down swing.
Figure 6:
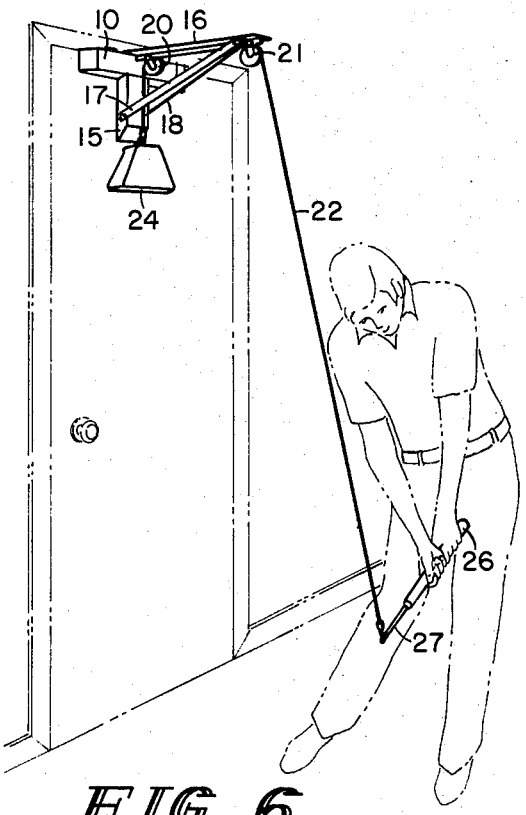
FIG. 6 is a simulated view of a golfer utilizing the device at the entry into the hitting zone.

The device of this invention may be constructed from a wide variety of materials employing various combinations of metals, metal alloys, plastic or wood. In the construction of the prototype of the preferred embodiment, a combination of wood and metal components was employed and has proved satisfactory. Horizontal base 10 was fabricated with tapered ends 9 from a 16" length of 2 by 4. First door hook 11 and a second door hook 12 were formed from a 1" section of strap metal which projected downward 6" leaving a gap 8 between the horizontal base 10 a sufficient width to project over the top of a door or the beam utilized for suspending the device. Door hooks 11 and 12 were encased in a soft plastic hook cover 13 to avoid marring the surface of the door. The hooks 11 and 12 were secured to horizontal base 10 employing either bolts or leg screws as the hook to base securing means 14. For additional stability in supporting horizontal base 10, there was secured at the mid point of base 10 a vertical beam 15 which was formed from a wood member 2 by 4, 7" long. Secured directly above vertical beam 15 at the mid point of horizontal base 10 was a projecting "T" beam 16 formed from metal "T" 2" wide with the projecting stem to "T" 2" long. The preferred length of this projecting "T" beam has been determined to be 20". The base of projecting "T" beam 16 may be bolted or otherwise securely attached to horizontal base 10. To assist in the stability of projecting "T" beam, there was employed a first projecting beam stabilizer 17 and a second projecting beam stabilizer 18 whih consisted of a rigid piece of strap metal 1¼" wide and 20" long. These stabilizers 17 and 18 were securely attached to projecting "T" beam 16 and each side of the vertical beam 15 with stabilizer attaching means 19. The stabilizer attaching means 19 may comprise bolts with nuts or other secure mechanical stabilizing attachments. The arrangement of the foregoing structure is preferably, substantially as illustrated in FIGS. 1 and 2. Operably secured to the projecting "T" beam 16 adjacent horizontal base 10 is a 2½" door pulley 20, and adjacent the projecting end of "T" beam 16 is also attached a 2½" projecting pulley 21. Operably extending through each of these pulleys 20 and 21 is a flexible pulley rope 22 which may be a ⅛" to ¼" section of braided or securely twisted cord or rope. Attached to the end of pulley rope 22 adjacent base 10 was a 10 to 15 pound suspended weight 23. To avoid damage or scratching to the door or other surface from which the device is suspended, the weight is desirably covered with a resilient weight cover 24. Another weight system that might be employed could be a bag of lead shot or equivalent structure. In the preferred embodiment, a swivel-like attachment was secured to suspended weight 23 which is illustrated as a weight rope attaching means 25. The opposite end of pulley rope 22 projecting through the projecting pulley 21 had attached to it a golf grip 26 which is mounted on a short section of golf grip shaft 27. Golf grip is approximately 11" long and the golf grip shaft 27 is 16" long. It is perferable that the end of the golf grip shaft 27 adjacent the pulley rope 22 be constructed with a golf grip shaft swivel 28. An eye bolt like structure may be utilized which is bent or curved into the section projecting through the golf shaft 27 which is designated as a shaft swivel attachment 29. The eye bolt end of the device may be constructed with a ring which may comprise the swivel rope attachment 30.

OPERATION OF THE DEVICE

With the golf swing exercise device supported in position suspended from a door or beam, or in the alternative, installation with the horizontal base 10 attached to a wall, the golf grip 26 would be suspended adjacent the head of the golfer. The golfer would grasp the golf grip 26 in a manner simulating a golf club at the top of the back swing. The suspended weight 23 places tension on pulley rope 22 which resists the downward movement of golf grip 26, shaft 27, tensioning rope 22, resisting the swing of the golfer. This weight or tension, resisting the movement of rope 22 as the golfer simulates the down swing, exercises those muscles utilized by the golfer at the top of his back swing and progressively through the down swing to the hitting zone. The device of this invention may be employed in a variety of situations indoors in inclement weather to acquire or maintain muscle tone and neuromuscular reflexes of the golfer.

Although the preferred embodiment of this invention has been described in detail suggesting the utilization of a first door hook 11 and a second door hook 12 to support the device, an obvious alternative utilization of the device would be to attach the horizontal base 10 to a wall or some other vertical support means and utilize the device in a fixed or semi-permanent installation. Other methods of use or methods of securing are apparent from an examination of the drawings, components of the device, and its utilization. What is desired to be claimed is all modifications in the device and its utilization not departing from the scope of equivalents of the appended claims.

I claim:

1. A portable golf swing exercise device adapted to be attached and supported by a door, wall, or other upright structure for positioning above a golfer's head comprising:

(a) elongated base means adapted to project along a vertical plane surface;

(b) base support means attached to said elongated base means for mounting said elongated base means on a vertical plane surface above said golfer's head retaining said base means in a stable position;

(c) a projecting beam with a first end secured to said elongated base means and projecting normal thereto, said projecting beam having a second end;

(d) a stabilizer secured at one end of said elongated base means and projecting upward from an extension of said elongated base means at an angle to said second end of said projecting beam interconnecting and retaining said elongated base and said projecting beam in a fixed spaced position;

(e) a first pulley attached to said projecting beam adjacent to said first end;

(f) a second pulley attached to said projecting beam adjacent to said second end;

(g) rope means passing through said first and second pulleys;

(h) golf grip means attached to a first end of said rope means nearest said second pulley; and (i) load means attached to a second end of said rope means nearest said first pulley, said load means moving responsive to movement of said golf grip means by said golfer to simulate swinging of a golf club through approximately 180 degrees of swing.

2. The invention of claim 1 wherein said base support means comprises:

a. said base means having a horizontally extending portion, a first hook secured to the said horizontal portion of the elongated base means, and b. a second hook spaced from said first hook secured to the horizontal base of the elongated base means.

3. The invention of claim 2 wherein said first and second hooks are encased in a resilient cover.

4. The invention of claim 1, further including a shaft wherein said golf grip means is mounted on a shaft and said shaft is secured to said rope means.

5. The invention of claim 1 wherein said load means comprises a weight attached to said rope means.

6. The invention of claim 5 wherein said weight is encased in a resilient cover.

* * * * *